US007360765B1

(12) United States Patent
Cheung et al.

(10) Patent No.: US 7,360,765 B1
(45) Date of Patent: Apr. 22, 2008

(54) POKER STYLE GAME AND METHOD

(76) Inventors: Yuk Cheung, 425 Solano Ave., Apt. 1, Los Angeles, CA (US) 90012-1265; Tony Cheung, 425 Solano Ave., Apt. 1, Los Angeles, CA (US) 90012-1265

( * ) Notice: Subject to any disclaimer, the term of this patent is extended or adjusted under 35 U.S.C. 154(b) by 0 days.

(21) Appl. No.: 11/045,661

(22) Filed: Jan. 31, 2005

(51) Int. Cl.
*A63F 1/00* (2006.01)

(52) U.S. Cl. ..... 273/292; 273/274

(58) Field of Classification Search ..... 273/292, 273/309, 274; 463/12, 13
See application file for complete search history.

(56) References Cited

U.S. PATENT DOCUMENTS 4,659,087 A * 4/1987 Shen et al. ..... 273/274
5,788,241 A * 8/1998 Ung ..... 273/292
6,439,574 B1 * 8/2002 Robinson ..... 273/292
6,776,415 B2 * 8/2004 Robinson et al. ..... 273/292
6,779,795 B1 * 8/2004 Le ..... 273/292
2003/0094761 A1 * 5/2003 Furuta et al. ..... 273/292

OTHER PUBLICATIONS

"9's Up, Harrah's Lake Tahoe Resort Casino", 1988.*

* cited by examiner

*Primary Examiner*—Benjamin Layno
(74) *Attorney, Agent, or Firm*—William W. Haefliger

(57) ABSTRACT

A poker type game playing card or domino game wherein dealt sets of cards or dominos are allocated, according to a routine that includes placement of a marker for determining active players; and each player organizes his set into two groups, A and B, and the strength of those two groups are compared with a dealer's corresponding A and B groups, to determine a win.

1 Claim, 7 Drawing Sheets

A " High 1 " Consists of: Fig: 3
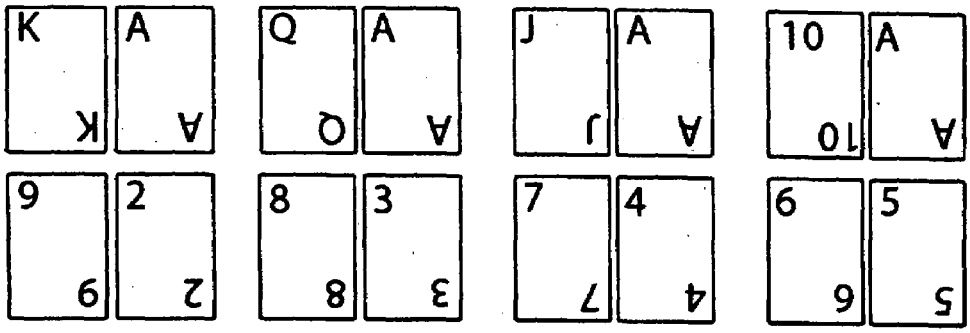
A " ZERO " Consists of: Fig: 4
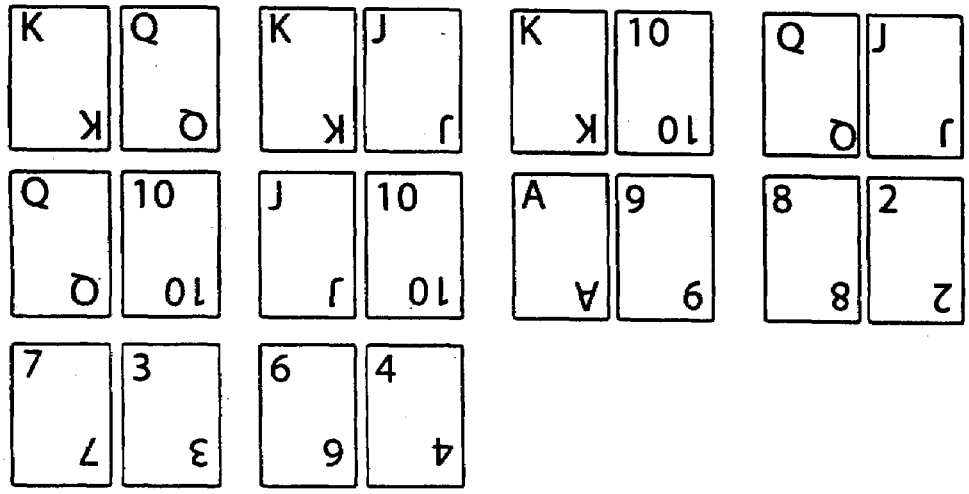

A High 5" Consists of: Fig:5
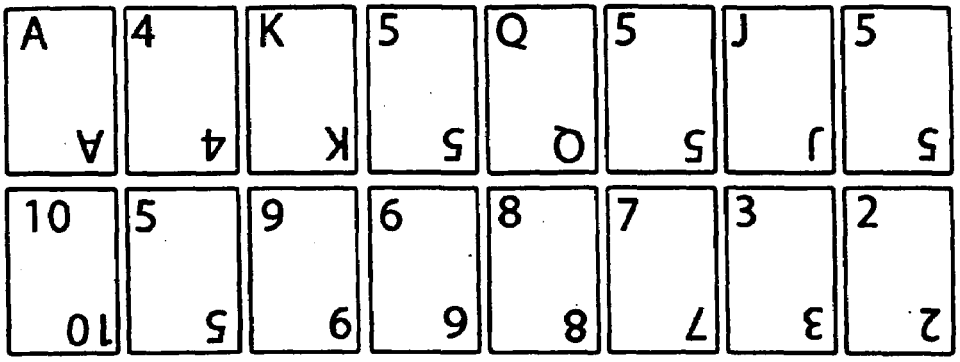
A " High 4" Consists of: Fig:6
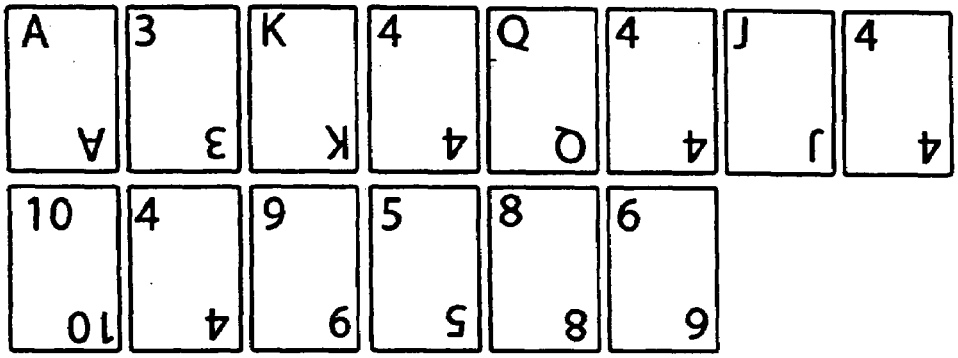
A " High 3" Consists of: Fig:7
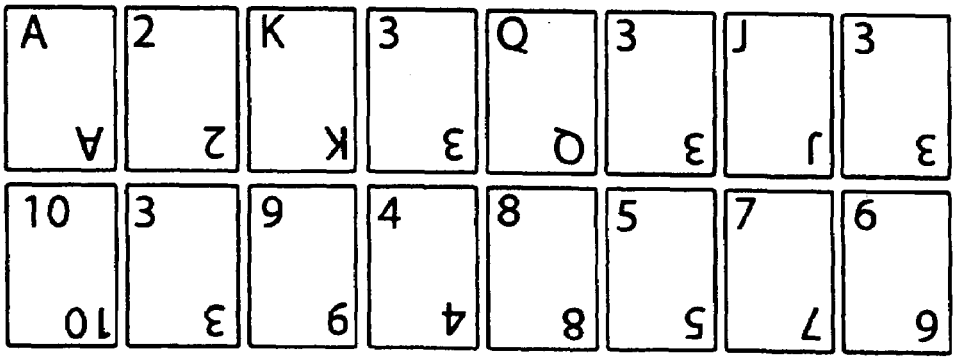

A " High 2" Consists of: Fig:8
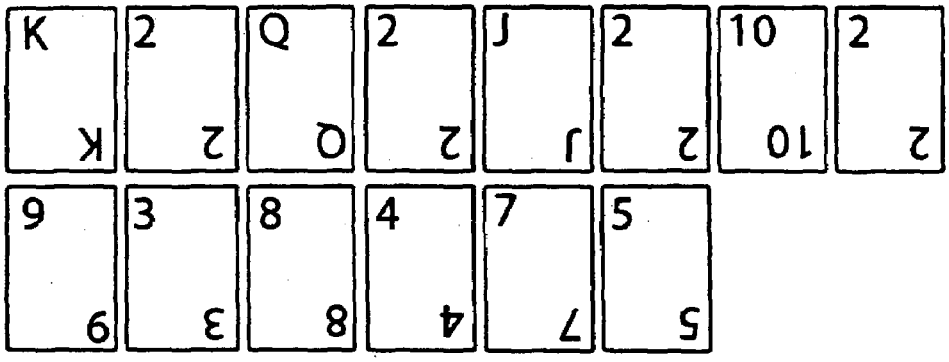
A " High 9 " Consists of: Fig:9
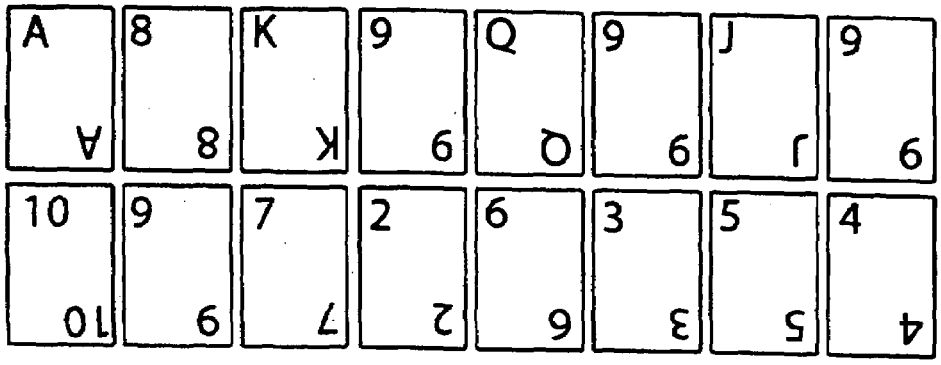
A " High 8 " Consists of: Fig: 10
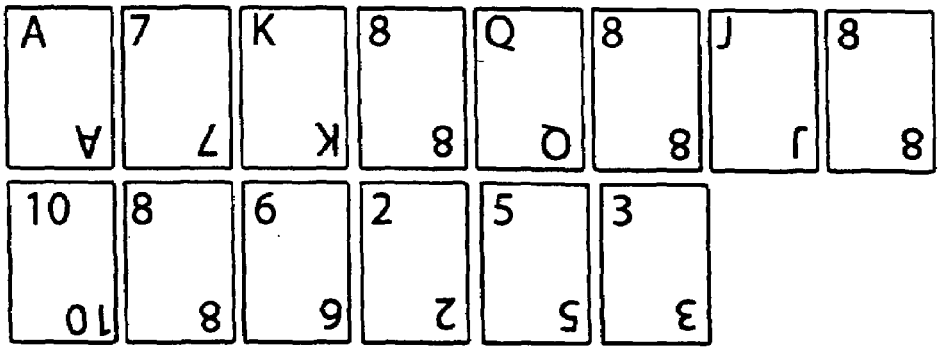

A " High 7 " Consists of: Fig: 11
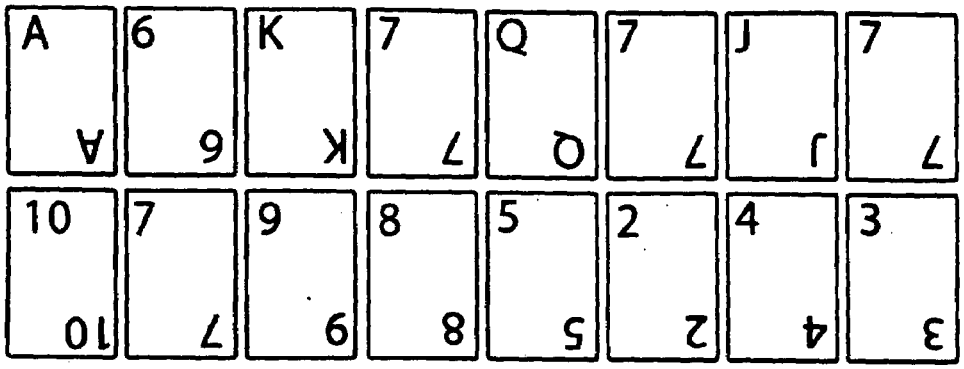
A " High 6 " Consists of: Fig: 12
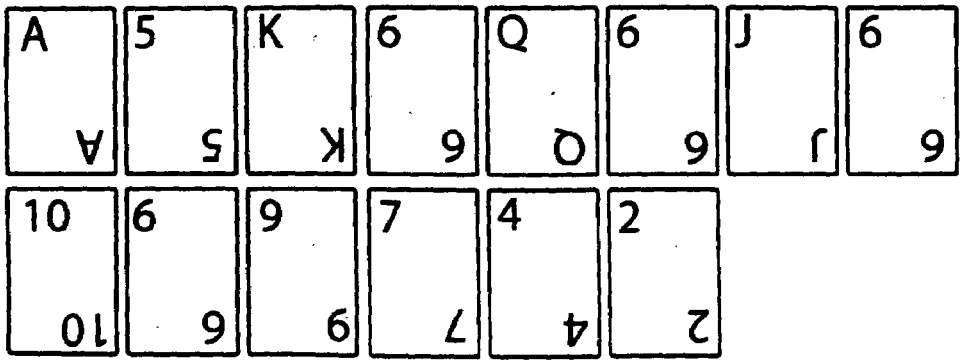

Pair Ranking:
The pair ranking is from the highest Ranking to the lowest pair ranking as shown: Fig:13
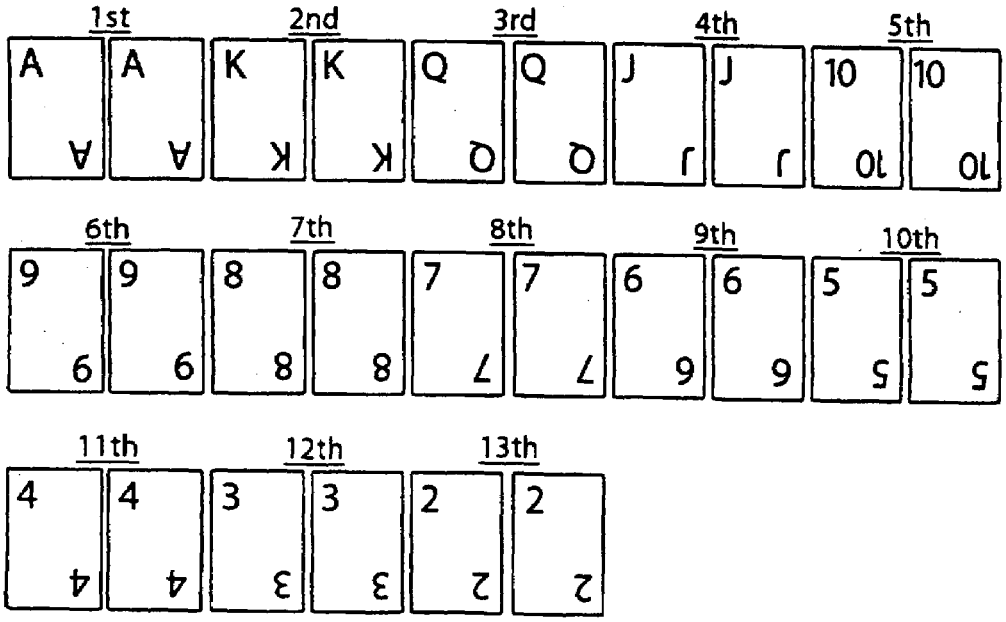

Single Ranking:
The single ranking is from the highest Ranking to the lowest ranking as shown: Fig:14
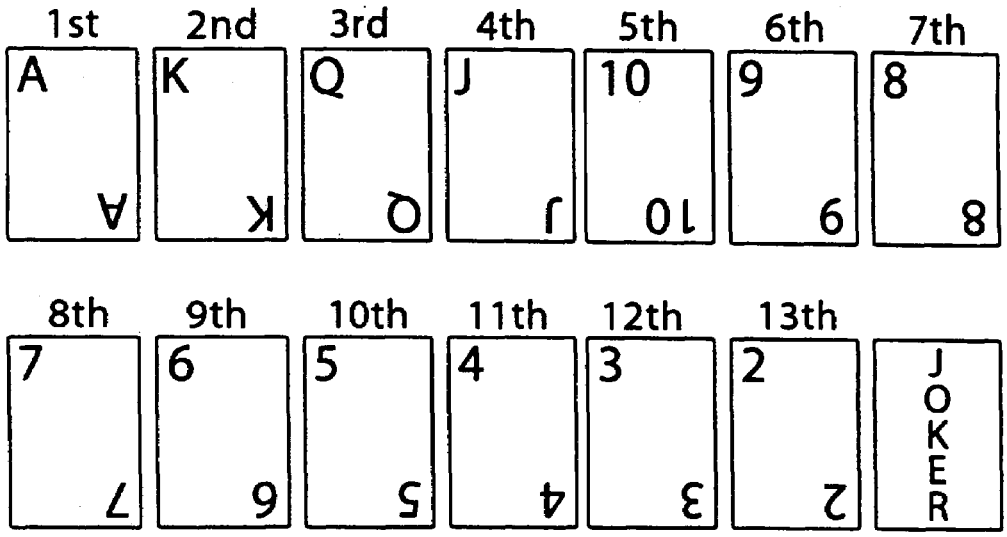

POKER STYLE GAME AND METHOD

BACKGROUND OF THE INVENTION

This invention relates generally to provision of a card or domino game, and its method of play, and more particularly to a game wherein each player arranges dealt cards or dominos in multiple groups to establish multiple group total strength, to be compared with dealer multiple group card or domino total strength, to establish a winner or winners.

SUMMARY OF THE INVENTION

It is an object of the invention to provide an improved card game to be played by a sequence of active players, to whom groups of cards are dealt, so that multiple card or domino groups can be compared, as referred to.

It is another object of the invention to provide a sequence of player positions on a support so that multiple groups of card or domino strengths can be compared, as referred to. Such a sequence is preferably established so that active players in the sequence can be chosen, in player positions presented toward a dealer position, for group strength comparison, as referred to. The sequence is preferably established along an arc that is concave toward a dealer position, and on a support such as a mat.

Yet another object is to provide a method of active player selection, along the arc, as by throwing of dice to select an initial player position along the arc, from which successive player positions become established lengthwise along the arc.

An additional object is to provide a method of playing a card game wherein there are at least 3 sequences of cards, each sequence including at least the following: A, K, Q, J, 10, 9, 8, 7, 6, 5, 4, 3, 2, with numerical values assigned to said A, K, Q, and J cards, the method including the steps:

a) establishing a sequence of player positions, b) dealing sets of said cards to spots corresponding to players having corresponding player funds; and wherein each set consists of A and B groups of at least two cards, the organization of cards in said groups into A and B sub-groups to be subsequently determined by the players, and allocating the sets of cards at such spots to the active players according to die or dice throw, the first allocation being from a spot determined by placement of a marker, c) and determining a winning player by comparing the strengths of the A groups of cards of the players with the A group of cards held by the dealer, and the strength of the B groups of cards of the players with the B group of cards held by the dealer, whereby if the strength of the A group of cards held by a player exceeds the strength of the A group of cards held by a dealer, and if the strength of the B group of cards held by a player exceeds the strength of the B group of cards held by a dealer, only then is a player a winner.

A similar game, using dominos is also provided, as will appear.

These and other objects and advantages of the invention, as well as the details of an illustrative embodiment, will be more fully understood from the following specification and drawings, in which:

DRAWING DESCRIPTION

FIGS. 3-12 show card group valuations;

FIG. 13 shows card pair ranking from the highest pair ranking to the lowest pair ranking; and FIG. 14 shows single card ranking from the highest to the lowest.

DETAILED DESCRIPTION

Figure 1:
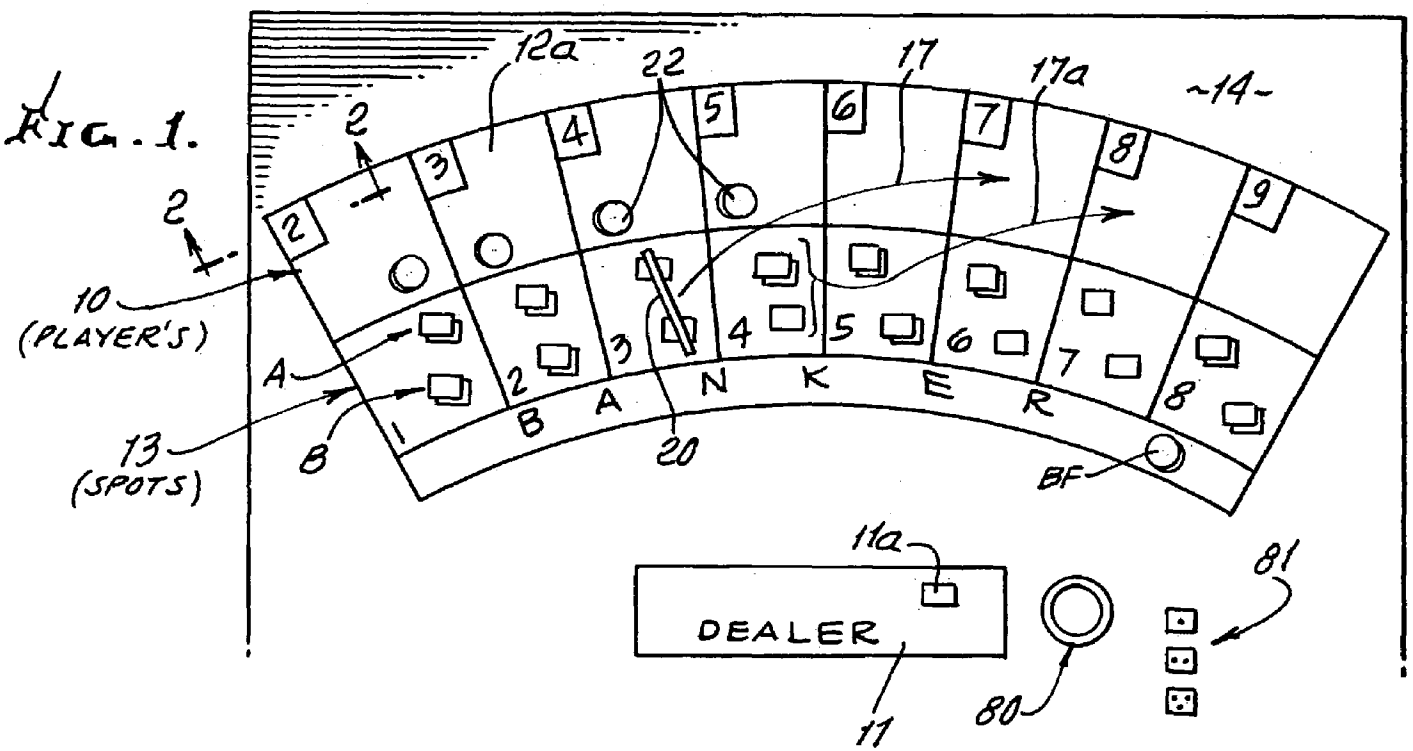
FIG. 1 is a plan view showing a play configuration.
Figure 2:
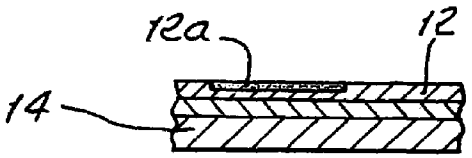
FIG. 2 is an enlarged section taken on lines 2-2 of FIG. 1.

Referring to the drawings, a sequence of player positions 10, and a dealer position 11, are established, as for example on a support 12 such as a mat. Those positions may be embedded in or on the mat, as by embossed, printed or otherwise applied indicia 12*a*; see FIG. 2, for example. The support may be configured as a mat, as on a table 14, and the sequence is established so that each player position is presented or established along an arc that intersects the player positions, on the support. Nine representative player positions are shown, presented toward dealer position 11.

The object of the preferred game is for the players to organize or split a set of four cards into two hands; first hand A of two cards and second hand B of two cards, and having both hands prospectively ranked higher than the banker's respective two hands, A and B, which he organizes, for hand valuation. Strategywise, every active player must consider, when organizing his/her own cards, that the second hand B needs to be stronger than the first hand A (ranked higher). These considerations also apply when playing with dominos instead of cards.

Delivery

In play, the dealer shuffles and deals each card face-down onto position spots 13, spaced from 10, and numbered 1 to 8; he then deals from 1 to 8, then backwards 8 to 1, which is repeated until four cards are in or at each spot, with either the eight or twenty-one remaining cards in the deck counted and kept face down by the dealer, as at 11*a*. If the number of remaining cards is not correct, the dealer must reshuffle and deal again. In this regard the play is typically with 53 cards (standard deck of playing cards) plus one joker wild; or 40 cards (any three suits out of a standard deck of playing cards) plus one joker wild. Joker wild can typically be used as any card.

Play with dominos is typically with 40 dominos (thirty nine dominos resembling 3 sets of Ace to King) plus one joker wild. Joker wild can be used as any domino.

Play is preferably on a casino table 14, with between two to eight players, and a non-player dealer, using one dice cup 80 containing three dice 81, an action marker 20 and a banker marker. Player positions are indicated at 10.

If dominos are used, the dealer shuffles and puts four dominos face-down onto one single set (stack) at each spot 13, and putting a total of 10 sets side by side. Afterward, the player or banker indicates to the dealer which two sets are to be taken out before starting off in delivery. Accordingly, if cards or dominos are used, they are to be delivered from eight spots.

Next, the player/banker places an action marker 20 on top of any dealt set of cards or dominos of his/her choice so as to indicate which set of cards/dominos at a spot is to start off in delivery. See for example marker 20 placed on the set, of cards at spot 3. In this regard, the player/banker then designates which set of cards/dominos go to which players by shaking the dice cup with three dice, and throwing, the dice throw total number indicating the first active player, as follows: the dealer unveils the result of the dice throw, sums up the number, then counts clock-wise, position to position, from player/banker's position until the number on the dice throw is reached (for example 7), to give the player corresponding to that position the set of cards/dominos under the action marker (see arrow 17), continuing allotments clockwise so that player at position 8 gets the card/dominos set at spot 4 (see arrow 17*a*), and so on until all sets at the spots have been allotted. The dealer keeps the remaining player/banker's cards/dominos at 11*a* inside the dealer's position. Each active player, receiving four cards organizes them into two hands, hand A with two cards and hand B with two cards.

The results of subsequent card/domino comparison are defined as follows:

Win

Player wins both the first and second hands A and B (as compared with the dealer's first and second hands respectively).

Lose

Player loses both the first and second hands (i.e. their strengths are below those of the dealer's first and second hands).

Push

Player wins one hand A and loses/ties the other hand B.

Copy Lose

Player loses one hand A and ties the other hand B, or ties both hands.

Misdeal

Occurs if a joker or an ace is exposed while the dealer is dealing or during delivery. A misdeal also occurs if the dealer puts the action marker onto the wrong spot and the players have looked at their cards. Also occurs if there are more than 5 cards dealt in any set.

Basic Rules

The play is at a table referred to above. Between two to eight players can play, with or without a non-player dealer, one dice cup containing three dice, an action marker and a banker marker.

The opportunity to bank typically rotates clock-wise from player to player. Any active player may elect to be the banker in turn for two consecutive games, then rotating clock-wise again to the next player. If a player does not wish to be the banker, he/she can decline and passes the opportunity to bank to the next player.

Dealer shuffles and deals the cards/dominos according to the delivery as previously described. The marker is put in front of the player/banker. The player/banker typically tells the dealer which set of cards/dominos to place the action marker on top of, so as to designate the set of cards/dominos to start off delivery.

Players have placed their bets, as by stacking chips or funds in front of their positions. See at 22. The player/banker designates which set of cards/dominos go to which player by shaking a dice cup with three dice. The dealer unveils the result of the dice, sums up the number, then counts clock-wise, position to position from player/banker's position until the number on the dice is reached, to give that player's position the set of cards/dominos under the action marker, continuing clock-wise to the next spot for allocating the set of cards/dominos at that spot, and so on until all cards/dominos at the spots have been allotted. Then the dealer keeps the remaining player/banker's cards/dominos inside the dealer's spot. The banker removes any cards/dominos that have no corresponding player, and keeps them face-down.

Players set or organize their cards/dominos into two hands and face down (first hand A is placed in front of the second hand B); the second hand needs to be stronger than the first hand (ranked higher), as determined by card or domino organization in each hand. Once all of the player's cards/dominos are set, or organized, this is recognized and the dealer turns over and sets the player/banker's hands according to instruction from player/banker. Player/banker confirms to the dealer that his/her hand has been set properly. Starting from the player who received cards/dominos under the action marker, dealer goes clock-wise around the table comparing the player/banker hand to the players' hands, taking, paying or pushing off bets.

Typically, cards are number rated, as in the referenced FIGS. 3-14.

An additional step may be considered to include:

$x_1$) establishing a banker fund in amount BF, $x_2$) establishing a sequence of active player ($P_1$, $P_2$, etc.) funds $P_1F$, $P_2F$, $P_3F$ corresponding to active players.

An equivalent game can be played where A and B are numbers other than two; as for example A is three and B is three.

We claim:

1. The method of playing a domino game, that includes the steps:

a) providing 40 dominos comprising 3 sequences of dominos each sequence corresponding to Ace to King playing cards, plus only one joker wild, b) establishing a sequence of player positions and active players at certain of said positions, c) dealing sets of dominos to spots corresponding to the active players having corresponding player funds; and wherein each set consists of A and B groups of at least two dominos, the organization of dominos in said groups into A and B groups being subsequently determined by the players, and allocating the set of dominos at said spots to the active players according to die or dice throw, the final allocation being from a selected spot determined by placement of a marker, that spot having a number in said sequence equal to the die or dice thrown number, and including the steps providing said marker, throwing the die or dice to provide said die or dice thrown number, placing said marker at or proximate said position sequence for determining the position of said selected spot, as aforesaid, d) and determining a winning player by comparing the strengths of the A groups of dominos of the players with the A group of dominos held by the dealer, and the strength of the B groups of dominos of the players with the B group of dominos held by the dealer, whereby if the strength of the A group of dominos held by the player exceeds the strength of the A group of dominos held by the dealer, and if the strength of the B group of dominos held by the player exceeds the strength of the B group of dominos held by the dealer, only then is that player a winner, e) and employing said die or dice thrown number to determine the active players which is less than the total number of said a) step player positions, f) and wherein for each player the numerical value of a player's A group must exceed the numerical value of the B group, wherein in the event of four dealt dominos of equal numerical value, the value of the A group equals the value of the B group and the hand has no value.

* * * * *